United States Patent [19]

Salsbury

[11] 4,429,555

[45] Feb. 7, 1984

[54] REVOLVING CYLINDER LOCKS

[75] Inventor: Michael A. Salsbury, South Godstone, England

[73] Assignee: Multikey Ltd., England

[21] Appl. No.: 249,809

[22] Filed: Apr. 1, 1981

[30] Foreign Application Priority Data

Apr. 2, 1980 [GB] United Kingdom ..... 8011094

[51] Int. Cl.[3] ..... E05B 29/00; E05B 19/14

[52] U.S. Cl. ..... 70/366; 70/401

[58] Field of Search ..... 70/366, 365, 362, 377, 70/401, 404

[56] References Cited

U.S. PATENT DOCUMENTS 615,207 11/1898 Babcock ..... 70/366

2,440,433 4/1948 Best ..... 70/366

FOREIGN PATENT DOCUMENTS 372612 3/1923 Fed. Rep. of Germany ..... 70/366

*Primary Examiner*—Robert L. Wolfe

*Attorney, Agent, or Firm*—Karl W. Flocks; Sheridan Neimark

[57] ABSTRACT

A revolving cylinder lock having a locking pin extending parallel to the axis of rotation of a barrel part within a cylindric passage and, in the locked condition, received in both a first cavity part extending into the wall of the passage and a second cavity part extending into the barrel and unlocking means angularly displaceable about the axis by a key to an unlocking position and retained between inner and outer guide surfaces and having an edge surface operatively associated with the outer guide surface and the pin and configured normally to retain the pin in the locked condition and, in the unlocking position to release the pin from engagement in the first cavity part and allow the barrel part to be rotatable relative to the housing, means being provided to urge the unlocking means away from the unlocking position.

16 Claims, 11 Drawing Figures

Figure 1:
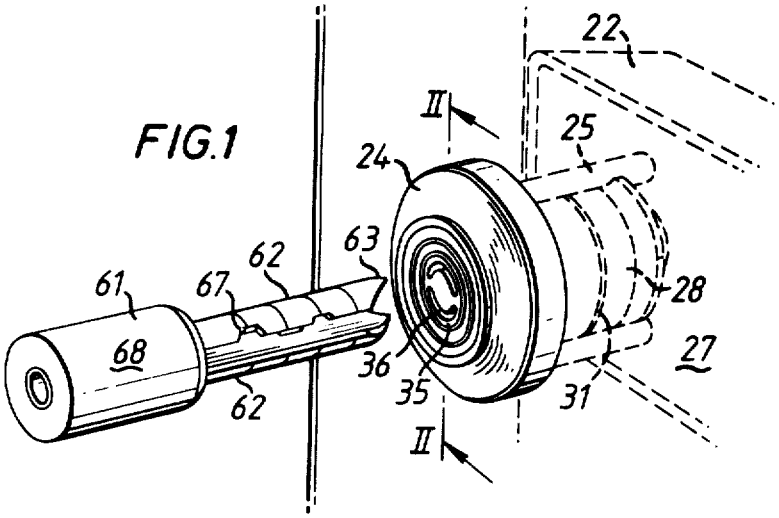

FIG. 3
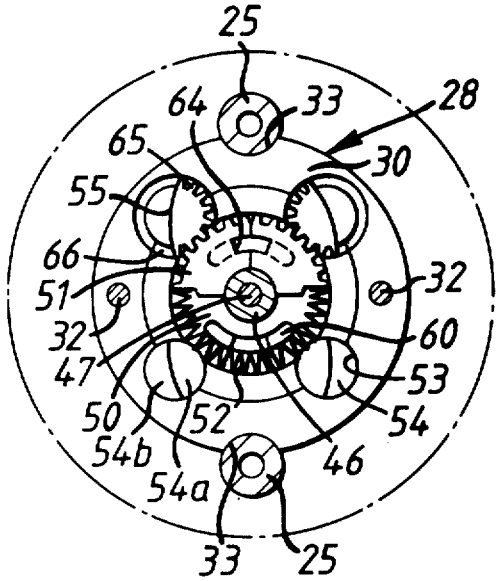
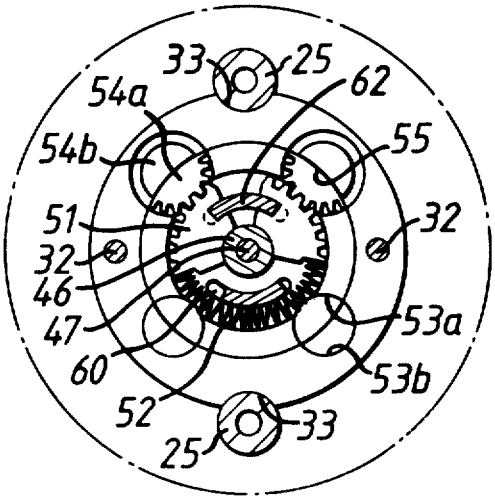
FIG. 4

REVOLVING CYLINDER LOCKS

This invention relates to revolving cylinder locks.

According to the present invention there is provided a revolving cylinder lock comprising a cylindrical barrel mounted coaxially in a cylindrical passage for rotation about the axis thereof characterized by a first cavity part extending into the wall of the passage, a second cavity part extending into the barrel, a pin extending in a direction parallel to the axis of the passage and, in the locked condition of the lock extending into both the first and second cavity parts, unlocking means retained between inner and outer guide surfaces concentric with said axis and angularly displaceable about said axis to an unlocking position, an edge surface on said unlocking means operatively associated with said outer guide surface and said pin and configured normally to retain the pin in the locked condition and in the unlocking position to release the pin from engagement in the first cavity part and allow the barrel to be rotated relative to the passage and means operable to urge the unlocking means away from the unlocking position.

In one embodiment of the invention the first and second cavity parts define a cylindrical cavity the axis of which is parallel to the axis of the barrel and is spaced therefrom by a distance not less than the radius of the barrel and not greater than the radius of the passage wall, the pin is one part of a two-part cylindrical pin coaxially mounted in the cavity for rotation therein about its axis, the cylindrical pin being divided into two parts along a cylindrical surface containing the pin axis and having a radius of curvature not less than that of the barrel and not greater than that of the passage and the edge surface of the unlocking means engages the one part of the cylindrical pin angularly to displace the cylindrical pin about its axis from the locked condition in which said one pin part extends into both the first and second cavity parts with the axis of the cylindrical dividing surface displaced from coincidence with the barrel axis to the unlocked condition in which the one part of the cylindrical pin is outside the first cavity part and the axis of the cylindrical dividing surface substantially coincides with the axis of the barrel.

In another embodiment of the invention the pin is a substantially cylindrical pin and the edge surface of the unlocking means is configured to engage the pin and prevent radial displacement thereof out of the first cavity part and is formed with a recess which in the unlocking position of the unlocking means is presented to the pin to allow radial displacement of the pin and release the pin from the first cavity part.

According to one aspect of the present invention there is provided a revolving cylinder lock comprising a cylindrical barrel mounted coaxially in a cylindrical passage for rotation about the axis thereof, a cylindrical cavity extending partly into the wall of the passage and partly into the barrel with its axis parallel the axis of the barrel and spaced from the axis of the barrel by a distance not less than the radius of the barrel and not greater than the radius of the passage wall, a cylindrical pin coaxially mounted in the cavity for rotation therein and divided into two parts along a cylindrical surface containing the pin axis and having a radius of curvature not less than that of the barrel and not greater than that of the passage, returning means operatively associated with the pin to urge the pin towards an angularly displaced position about its axis in which the axis of the cylindrical dividing surface is displaced from coincidence with the barrel axis and unlocking means operable angularly to displace the pin about its axis to bring the axis of the cylindrical dividing surface into coincidence with the axis of the barrel against the effect of the returning means.

It will be understood that although the barrel is a close fit in the passage, it is freely rotatable therein and, although in practice the radius of the passage would be very slightly larger than the radius of the barrel to prevent binding, for the purposes of the disclosure, the radius of the barrel, the radius of the passage and the radius of the cylindrical dividing surface of the pin may be considered equal to each other.

It is also to be understood that the word "cylinder" is used herein to denote a right circular cylinder.

It is preferred to provide a plurality of cylindrical pins each rotatable in an associated cylindrical cavity. Such pins may be angularly disposed about the axis of rotation of the barrel or spaced lengthwise in a direction parallel of the axis of rotation.

In a preferred construction, a plurality of divided cylindrical pins is provided, such a plurality of pins being divided into sets the pins of which are angularly disposed about the axis of rotation of the barrel and each set comprises two or more pins with the sets spaced axially of each other.

According to another embodiment of the invention there is provided a revolving cylinder lock comprising a cylindrical barrel mounted coaxially in a cylindrical passage for rotation about the axis thereof characterized by a first cavity part extending into the wall of the passage, a second cavity part extending into the barrel, a pin extending in a direction parallel to the axis of the passage and, in the locked condition of the lock extending into both the first and second cavity parts, unlocking means retained between inner and outer guide surfaces concentric with said axis and angularly displaceable about said axis to an unlocking position, an edge surface on said unlocking means concentric about said axis and operatively associated with said outer guide surface and said pin normally to retain the pin in the locked condition, a recess in said edge surface operable to release the pin from engagement in said first cavity part when displaced into coincidence with said second cavity part and spring means operable to urge the unlocking means away from the unlocking position.

Figure 2:
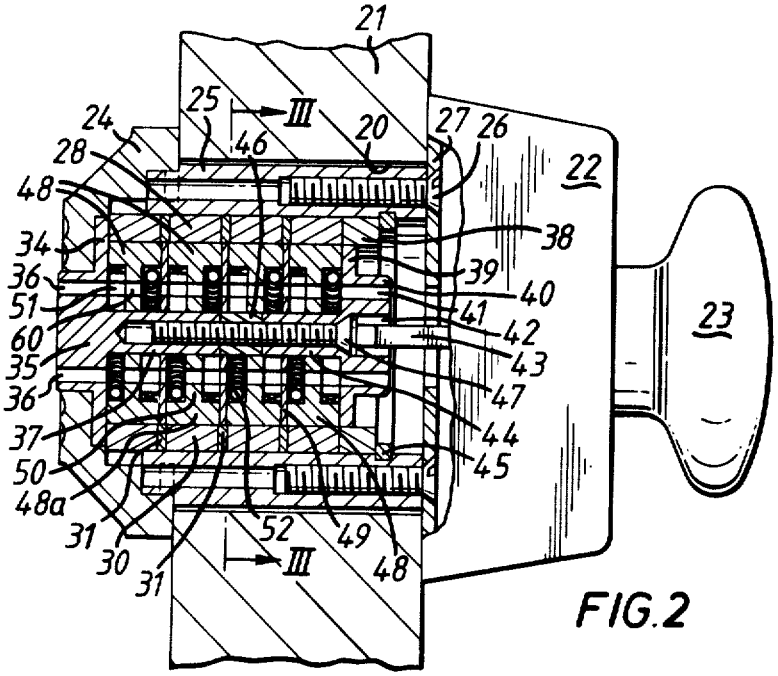
Figure 5:
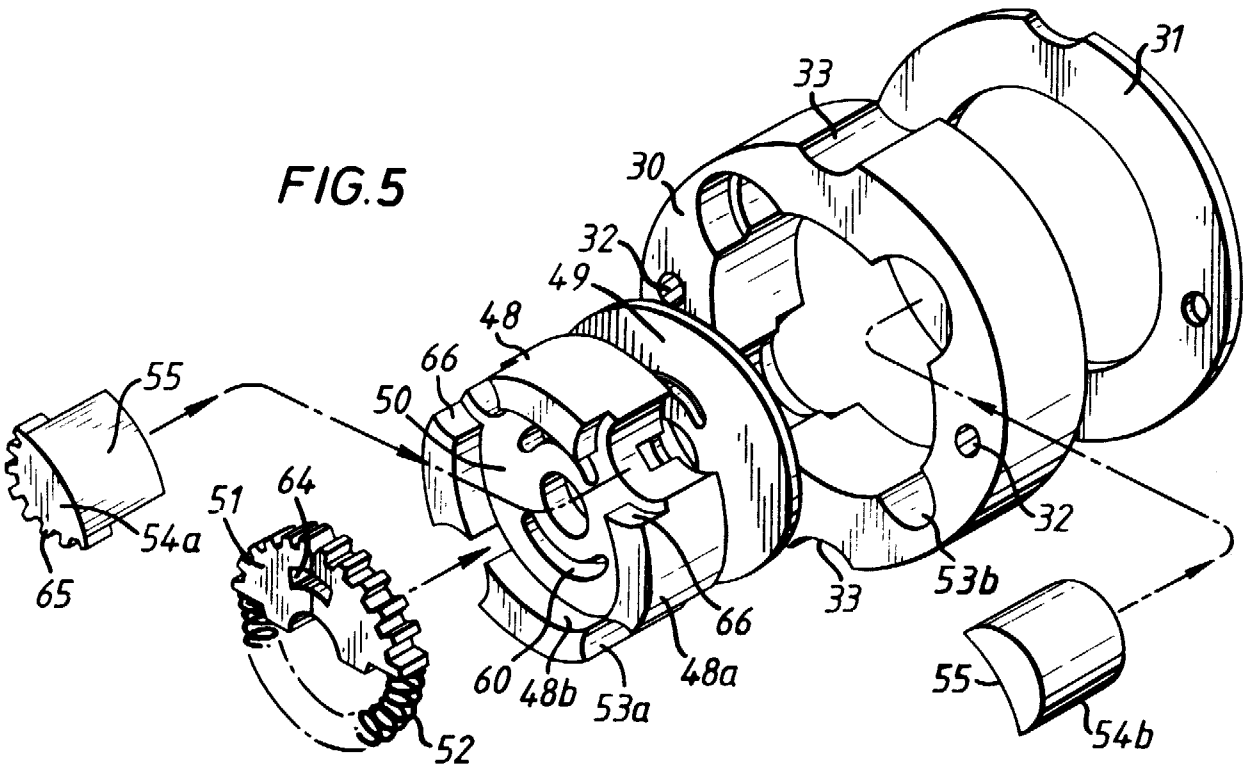
Figure 6:
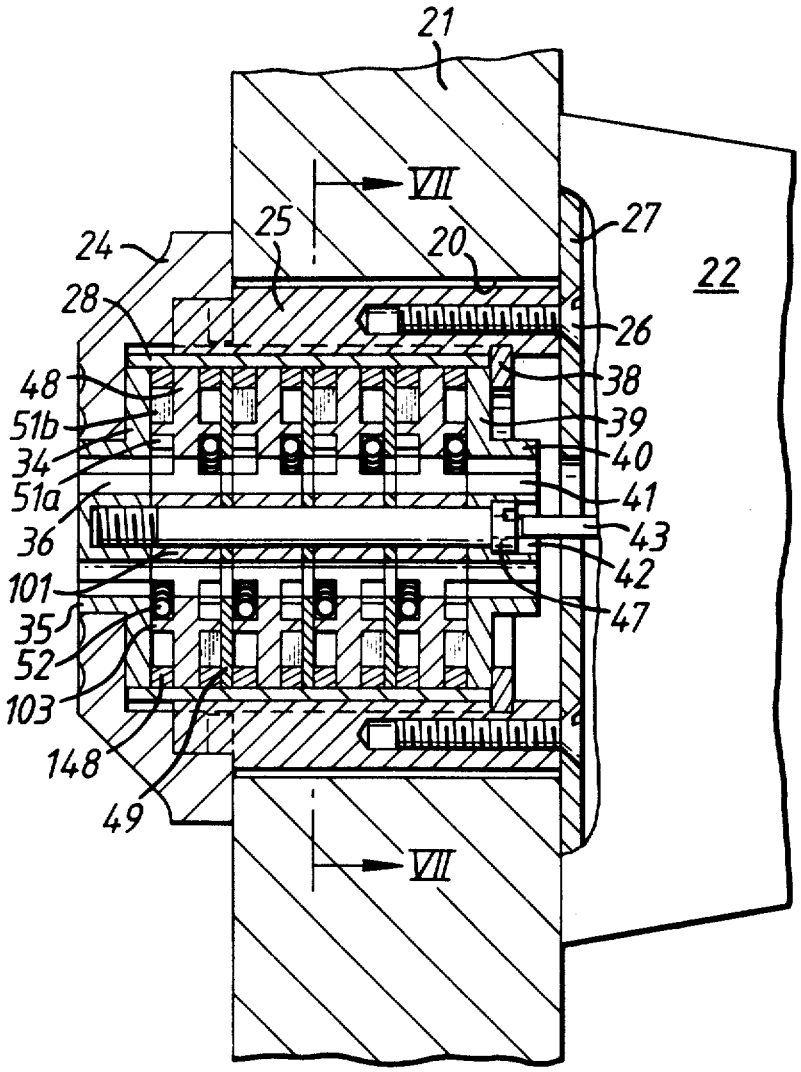
Figure 7:
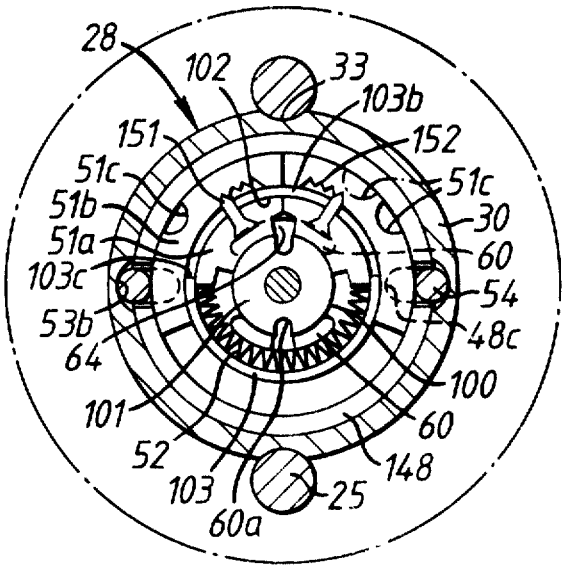
Figure 8:
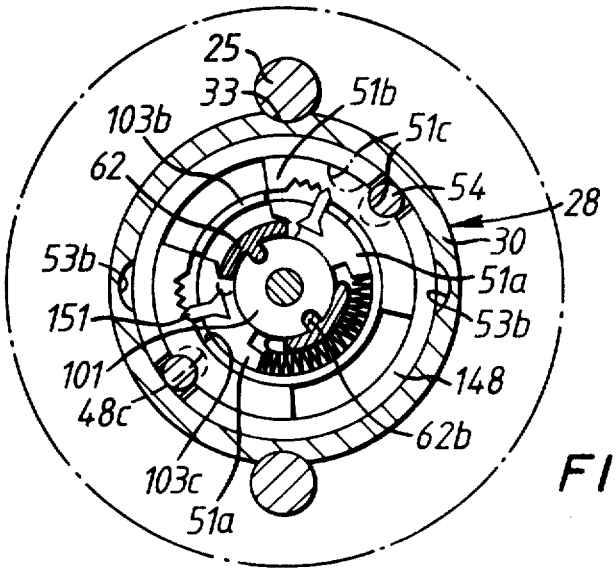
Figure 9:
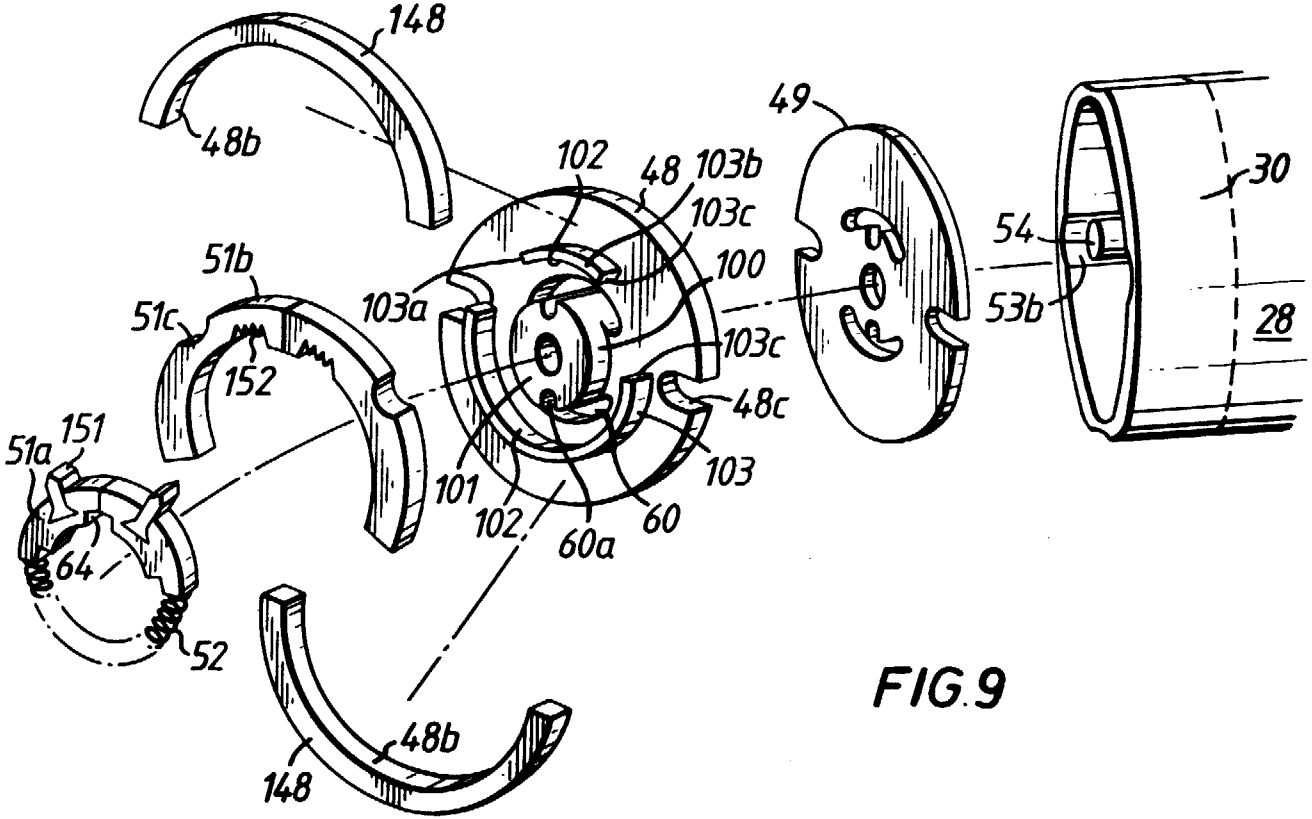
Figure 10:
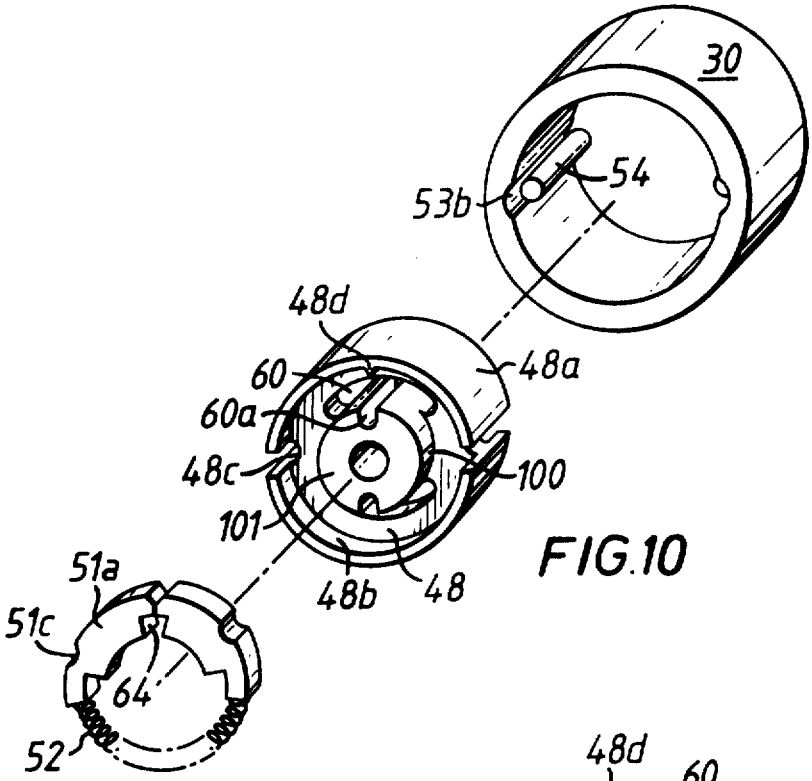
Figure 11:
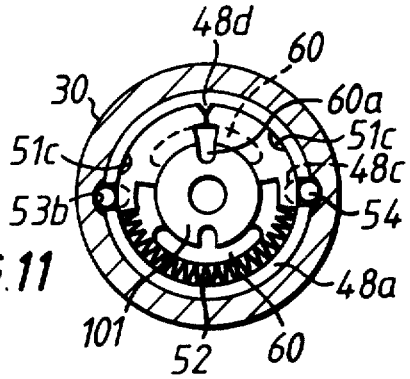

Embodiments of the invention will now be described by way of example, reference being made to the accompanying drawings, in which:

FIG. 1 is a perspective view of a lock according to the invention positioned in a door, FIG. 2 is an enlarged section taken on the line II—II of FIG. 1, FIG. 3 is a section taken on the line III—III of FIG. 2 effectively showing a plan view of a part of the lock shown in FIG. 2 with parts in the locked position, FIG. 4 is a view similar to FIG. 3 showing the parts in the unlocked condition, FIG. 5 is an enlarged exploded view of the part shown in FIG. 3 with some parts omitted, FIG. 6 is a sectional view to FIG. 2 illustrating another embodiment of the invention, FIG. 7 is a section taken on the line VII—VII of FIG. 6 showing the lock in the locked condition, FIG. 8 is a view similar to FIG. 7 showing the lock in the unlocked condition, FIG. 9 is an exploded view of the parts shown in FIG. 8, FIG. 10 is an exploded view similar to FIG. 9 illustrating a simplified lock according to the invention, and FIG. 11 is a sectional view similar to FIG. 7 of the simplified lock shown in the locked position.

FIGS. 1 to 5 show a lock embodying the invention extending through an aperture 20 from the front to the rear of a door 21 to the rear of which is attached conventional casing 22 containing the bolt operating mechanism which can also be manually operated by the knob 23.

The lock has a front plate 24 from which rearwardly extend two hollow rods 25 which are welded or otherwise secured to the front plate 24 and which are internally threaded at their ends remote from the front plate 24 for engagement by bolts 26 which pass through apertures in a rear plate 27 secured to the casing 22 thereby securing the lock to the door 21.

Between the rods 25 is disposed a substantially cylindrical housing 28 composed, in this example, of four similar annular parts 30 between which are disposed annular spacers 31, the parts 30 being secured together by pins 32. The rods 25 are located in external grooves 33 in the housing so that the latter is held against rotation. Between the front end of the housing and the front plate 24 is disposed a front end plate 34 having a forwardly projecting cylindrical boss 35 formed with two arcuate key holes 36 lying on the circumference of a circle about the axis of the lock and a rearwardly extending internally threaded sleeve 37. The front end plate is of a tough metal to protect the housing against drilling. At the rear end of the housing is a further annular part 38 within which is disposed a rear end plate 39 having a rearwardly extending annular boss 40 formed with corresponding key holes 41 and two diametrically opposed slots 42 to receive a bar 43 which, when rotated, retracts a bolt within the casing 22 in known way. The rear end plate has a forwardly extending sleeve 44. The housing 28 is secured in position by an annular spring clip 45 which engages in slots in the rods 25. The sleeves 37 and 44 together with an intermediate spacer sleeve 46 are secured together by a bolt 47 which passes freely through the sleeves 44 and 46 and threadedly engages the sleeve 37 so that the sleeves form a shaft or spindle about which are rotatably disposed four aligned cylindrical members 48 separated by spacers 49 to provide the rotatable barrel of the lock. Each such barrel member 48 is disposed as a rotating fit in a corresponding housing part 30 and has a peripheral wall 48*a* of an axial height corresponding to the axial length of a housing part 30 and a disc-like central part 50 so that when disposed about the spindle or shaft each barrel member 48 has a similar annular cavity on each of the opposed faces thereof in which are disposed two toothed segments 51 urged in opposite directions about the spindle or shaft into abutting engagement with each other by a spring 52.

The wall of each barrel member 48 is formed with four equiangularly spaced part-cylindrical cavities 53*a* and the inner wall of each housing part is formed with four equiangularly spaced part-cylindrical cavities 53*b* so that, when assembled each housing part 30 and associated barrel member 48 may be considered a sub-assembly provided with four cylindrical cavities 53 the axes of which are parallel to the axis of the lock, equiangularly disposed thereabout and spaced therefrom by a radius not less than that of the circumference of the barrel member 48 and not greater than that of the inner wall of the housing part 30. Within each cavity 53 is disposed as a rotating fit a cylindrical pin 54 divided into two parts 54*a* and 54*b* along a cylindrical surface 55 containing the pin axis and having a radius of curvature not less than the radius of the circumference of the barrel member 48 and not greater than that of the inner wall of the housing part 30.

Each disc-like central part 50 has two diametrically opposed arcuate slots 60 which are aligned with the slots 36 and 41 to accept a two-pronged key 61, the prongs 62 of which are similarly arcuate and lie on the circumference of a cylinder, the prongs 62 being tapered at their leading end as at 63. The two toothed segments 51 which lie in the annular cavity in each face of the barrel members 48 have matching slots 64 in their abutting radially extending sides to form a slot or opening of lesser arcuate length than slot 60 and which lies over a slot 60 and is arranged to accept the tapered end 63 of a key prong 62 so that the toothed segments 51 are forced apart as the key prongs are fully inserted.

Each toothed segment 51 engages corresponding teeth 65 formed on an annular flange provided on a pin part 54*a* so that the pin parts 54*a* and 54*b* are angularly displaced when the toothed segments 51 are forced apart by the insertion of the key prongs.

As there are two toothed segments 51 on each side of the disc-like central part 50 of each barrel member 48, the one ends of two adjacent part-cylindrical cavities 53*a* are enlarged, as at 66, to accommodate the teeth 65 on the associated and engaged pin part 54*a* and the other ends of the other two cavities 53*a* are similarly enlarged.

As will be understood from the above description of the lock of this embodiment of the invention, there are four sub-assemblies each of which includes four toothed segments 51 each of which controls the rotation or angular displacement of a corresponding pin 54 so that, in order to open the lock described, there are sixteen pins 54 to be angularly displaced by a predetermined amount from a normally locked position to the unlocked position.

The sub-assembly shown in FIG. 3 is shown in a normally locked position with the axes of the pin-dividing part-cylindrical surfaces 55 displaced from coincidence with the axis of the lock. In this position, the pins 54 prevent rotation of the barrel member 48 relative to the housing part 30. When the prongs 62 of the key 61 are entered into the slots 36 and pushed through the slots 60 in the sub-assemblies, the pairs of toothed-segments are pushed apart and angularly-displaced about the lock axis to correspondingly rotate the pins 54. The longitudinal edges of the prongs 62 are formed with recesses or drops 67 at axial distances from the head 68 of the key corresponding to the positions of the toothed segments to be displaced thereby. The toothed segments 51 return into the drops 67 in which position the associated pins 54 have been angularly displaced to a position in which the cylindrical surfaces 55 thereof have their axes coincident with the lock axis so that the barrel members 48 can be rotated relative to the housing parts 30, thereby rotating the bar 43 to unlock the bolt.

It will be appreciated that in making a key the magnitude of each drop 67 can be selected from any number of values, e.g., three, and that each pin 54 can only be rotated to the unlocking position when rotated by a drop of predetermined magnitude. In the case of a system employing three possible drop sizes and 16 pins as illustrated there are $3^{16}$ possible combinations for setting the lock. Furthermore, such a setting is readily accomplished without requiring a vast number of parts. In order to set a lock for a specific key, the barrel members 48 are removed from the annular housing formed by the housing parts 30 which are pinned together by the pins 32 with the spacer washers 31 therebetween and extending between the part-cylindrical cavities 53*b* to separate these and to provide support for the pin parts 54*b*. The pin parts 54*b* are then inserted into the part-cylindrical cavities 53*b* with the part cylindrical surface 55 as a continuation of the inner cylindrical wall of the associated sub-assembly 30. The front end plate 34 is passed over the prongs 62 of the key 61 to abut the head 68. The first barrel member 48 is then passed over the prongs 62 of the key which extend through the slots 60, the toothed segments 51 and springs 52 being positioned on each side of the barrel member 48. The spring urged toothed segments 51 fall into the appropriate drops 67 in the key and are therefore angularly displaced from the rest or locked position to a position representing the unlocked position for that specific key. The pin starts 54*a* are then inserted into the slots 53*a* so that the part-cylindrical dividing surface 55 is a continuation of the outer cylindrical surface of the barrel member 48 and their teeth 65 are in mesh with the toothed segments 51. The second barrel member 48 with its spacer 49 is then passed over the prongs and the process repeated until all the barrel members have their pin parts 54*a* positioned forming a barrel with a cylindrical outer surface which can then be inserted into the housing formed by the housing parts 30, each pin part 54*a* matching with a corresponding pin part 54*b*. The front plate 24 can then be placed in position together with the further annular part 38, the rear end plate 39 and spring clip 45 and the assembly is complete. When the key is withdrawn, the toothed segments are angularly displaced to the locked position in which each pair about each other under the influence of the spring 52, thereby rotating the pins 54 to the locked position in which the axes of the part-cylindrical surfaces 55 are displaced from coincidence with the lock axis. It will be seen that if a key is lost, the lock may be readily reset to suit another key without requiring any replacement parts and this can be done on site if necessary.

Where a key of the same pattern as the lost key is available and the lock is to be changed for operation by a different key, the procedure is even simpler than that described above. The old key is inserted to rotate the pins 54 to the unlocked position, the spring securing clip 45 is removed and the barrel members 48 are withdrawn from the housing as a unit on the bolt 47. The pin parts 54*b* drop out. The old key is removed and the new key is inserted thereby displacing the toothed segments 51 to the corresponding positions representing the new unlocked position. The pin parts 54*b* are then reinserted to engage the displaced toothed segments 51 with their part-cylindrical surface 55 as a continuation of the cylindrical surface of the barrel member unit which is then re-inserted into the housing and the spring securing clip 45 is replaced. The lock is now reset to the new key.

It will be appreciated that any desired number of sub-assemblies may be provided from one upwards and that each sub-assembly may have one or more pins which are angularly displaced about the lock axis. In the embodiment described with reference to FIGS. 1 to 5, each sub-assembly has four angularly displaced pins 54 and these may be regarded as a set of angularly displaced pins, such pins being axially spaced from similar pins in the other sets. Although the pins 54 of each set are described as being equiangularly displaced about the lock axis such equiangular spacing is not essential.

In the embodiment described, the insertion of a key causes each pair of toothed segments 51 to rotate the associated pins 54 in opposite directions. For security reasons this is considered to be an advantage.

It will be appreciated that in the arrangement described, the locked condition of the lock is achieved by the pin part 54*a* extending partly into the cavity part 53*a* in the barrel member 48 and partly into the cavity part 53*b* in the housing part 30 and the unlocking or released condition of the lock is achieved by the pin part 54*a* being received into the cavity part 53*a* of the barrel member and being clear of the cavity part 53*b* in the housing part 30. This change from the locked to the unlocking or released condition is achieved through the angular displacement of unlocking means, in this case the toothed segments 51, about the axis of the lock or the cylindrical passage in which the barrel members 48 are received which toothed segments 51 are retained between an outer guide surface provided by the inner wall 48*b* of that part of the peripheral wall 48*a* upstanding from the central part 50 of barrel member 48, the outer guide surface so provided being concentric about the axis referred to, and an inner guide surface provided by the outer wall of the shaft or spindle formed by the sleeves 37 and 44 and spacer sleeve 46. This inner guide surface is concentric about the axis referred to as can be seen, for example, in FIGS. 3 and 4. The segments 51 have a toothed edge surface which is operatively associated with the outer guide surface for guidance purposes and which engages the teeth 65 on the pin part 54*a* serving thereby both to retain the pin part 54*a* in the locked condition and, in the unlocking position to release the pin part from engagement in the cavity part 53*b*.

The pin part 54*a* extends in a direction parallel to the axis of the passage provided by the housing parts 30 and is effectively a pin which is displaced to achieve the locked and unlocked conditions of the lock and which in the embodiment described cooperates with a floating complementary pin 54*b* which restrains it against displacement other than angular displacement.

One of the advantages of the embodiment described, as has already been mentioned, is the facility with which it can be changed to suit a different key despite the high degree of security which it affords and the vast number of combinations available. This is of great benefit in organisations having a large number of locks under their control and where keys are inevitably lost from time to time. There is, however, one disadvantage, in that it does not lend itself to use with a master key. As is well known, where a lock is required to be capable of being unlocked both by the key intended for that lock and a master key which will open a number of locks, at least one of the locking pins must be capable of being displaced to two positions in which the lock is released, one position being determined by the normal key and the other by the master key. In the embodiment of the invention described, the pin parts 54*a* have, and can only have, one position in which the lock is released.

FIGS. 6 to 9 illustrate a modified lock embodying the invention which is capable of accommodating a master key system. This modified embodiment is similar to the embodiment previously described, the main differences being that the angularly displaceable unlocking means is formed into two parts drivingly connected by a radially extending tooth on one part engaging in one of a plurality of teeth on the other part to provide the adjustability for different key drops and a recess is provided in the edge surface of such part to enable the locking pin to be radially displaceable out of the cavity part in the housing part. Where such a lock is to be used in a master key system, a second angularly displaced recess can be provided in such other part of the unlocking means to provide a second angularly adjusted position at which the locking pin is released and, indeed, a third recess can be provided if a grand master system is required.

The modified embodiment will now be described in greater detail, like references being used to denote like parts with respect to the previous embodiment. In this case, the housing 28 is shown as a single cylinder but is preferably composed of a plurality of housing parts 30 and will be so described. The housing parts 30 are formed with only two diametrically opposed cavity parts 53*b*, and the barrel part 48 is formed with diametrically opposed slots 48*c* with the peripheral wall 48*a* of the previous embodiment replaced by a pair of annular keeper plates 148 on each face of the barrel part. These keeper plates 148 provide the outer guide surface 48*b* and extend each for nearly 180° about the lock axis so as to receive between them substantially cylindrical locking pins 54 at diametrically opposed locations.

Such locking pins 54 extend in a direction parallel to the lock axis and, in the locked position, each extends partly into an associated one of the cavity parts 53*b* and into the associated slot 48*c* in the barrel part 48. Each unlocking member is in two parts, an inner part 51*a* and an annular outer part 51*b*. The inner part 51*a* is angularly displaceable about the lock axis between an inner guide surface 100 provided by the wall of a central boss 101 integrally formed on each face of the barrel part 48 and an inner intermediate guide surface 102 provided by an annular rib 103 formed on each face of the barrel part 48 concentrically about the lock axis. Each inner part 51*a* has a radially extending pin or tooth 151 which engages between teeth 152 formed on the inner edge surface of the outer part 51*b*. The outer part 51*b* is angularly displaceable about the lock axis between an outer intermediate guide surface provided by the rib 103 and the outer guide surface 48*b*.

The annular rib 103 on each face of the barrel member is formed with two interruptions or gaps 103*a* through which the tooth 151 of the associated inner part 51*a* extends for engagement with the teeth 152 of the associated outer part 51*b*. The ends of these gaps 103*c* effectively provide limit stops engageable by the teeth 151 limiting the degree of angular displacement of the associated inner part 51*a* and subtend an angle of slightly less than 60° to the axis, e.g., 55° to 59°. Between the gaps 103*a* is left an upstanding part 103*b* of the rib 103 against which the teeth 151 of the two inner parts 51*a* abut in the locked condition. The outer edge surface of the outer part 51*b* of the unlocking member is formed with a part circular recess or cavity 51*c* which, in the locked condition is angularly displaced with respect to the associated cavity part 53*b* which is a continuation of the slot 48*c*. Each locking pin 54, in the locked condition extends partly into the cavity part 53*b* and the slot 48*c* but is held against inward radial displacement by the outer edge surface of the outer part 51*b* of the unlocking member although the slot 48*c* is of sufficient radial length to accommodate the whole of the locking pin 54, i.e., the radial length of the slot 48*c* is at least as great as the diameter of the locking pin 54.

In order to unlock the lock described, the prong 62 of a key is inserted into the lock and, by engagement in the slots 64 in the inner parts 51*a* angularly displaces the latter in opposite directions about the axis of the lock producing a corresponding displacement of the outer parts 51*b*. The inner parts 51*a*, under the influence of the spring 52 return to fall into the drops 67 of the key blade in which position the recesses 51*c* are aligned and lie over the associated slot 58*c* and are aligned with the associated locking pin 54 which is now free to move radially inwards. Thus the insertion of the key brings the lock to the unlocking or released condition in which the barrel members 48 are free to turn in the housing parts 30. Rotation of the key angularly displaces the barrel members 48 together with the parts 51*a* and 51*b* and the locking pins 54 ride out of the associated cavity parts 53*b* to be fully received in the associated slot 48*c*. The locking pins are carried around with the barrel parts 48 and the keeper plates 148 are constrained to move with the pins. This results in the bar 43 releasing the bolt in the casing 22 as previously described.

As has been previously mentioned, each barrel part 48 has a similar arrangement of parts on each face and, in order to achieve the released or unlocking condition, the recesses 51*c* in the outer parts 51*b* on one face need to be aligned with corresponding recesses 51*c* in the outer parts 51*b* on the other face to allow the locking pin 54 to fully enter its associated slot 48*c*. It is for this reason that only two locking pins 54 are required in this embodiment as such locking pins have an axial length such that they extend to both sides of a barrel member 48 and each pin requires the alignment of a recess 51*c* on each face with the associated slot 48*c* before it is free or released.

The procedure for modifying the lock of this embodiment to match a different key is much the same as that previously described. In this case, it is simply achieved by engaging the teeth 151 in an appropriate angularly displaced position with the teeth 152 to ensure that the recesses 51*c* are in the unlocking position with the new key inserted.

It will be noted that in the modified embodiment, the key receiving arcuate slots 60 in the barrel members 48 are formed centrally with a radially inwardly extending recess 60*a* which is intended to receive a corresponding longitudinally extending rib 62*b* on the inner face of the key prong 62. This functions not only to assist in locating the key during axial insertion, but also to enhance the leverage on the barrel members 48 as the key is rotated.

Where the lock is intended to accommodate a master key, one or more or all of the outer members 51*b* may be formed with a second recess 51*c* (shown in dotted lines) so that an outer member will have two angularly displaced positions in which it will release the associated pin 54. A third similar recess may be provided for a lock intended to accommodate an ordinary key, a master key and a grand master key.

In circumstances where, for additional security, two key-holders are required in order to open a door, the lock of the present invention may be used with each key-holder having a separate one of the two blades 62 so that only when both key-holders are present and both blades 62 are inserted can the lock be opened.

It will be noted that in this embodiment the barrel parts rotate directly about the bolt 47, the bosses 100 providing the necessary continuity of bearing surface.

Finally, the lock of the last described embodiment lends itself to the construction of a cheaper and simple lock in which the gearing provided by the teeth 151 and 152 is omitted, thereby losing the great ease with which the lock can be changed to suit a new key, but retaining the feature of the recess 51*c* whereby the lock can easily be suited for use with a master key. Such a simplified lock is illustrated in FIGS. 10 and 11 and like reference numerals are used to denote like parts.

This simplified embodiment need only be briefly described as its construction and operation will be readily understood from the foregoing description and FIGS. 10 and 11 of the accompanying drawings.

In this case, the selectively adjustable toothed gearing or drive within each angularly displaceable unlocking member is omitted so that each is made in one piece. The annular rib 103 is therefore also omitted as are the keeper plates 148. This means that the selective angular adjustment is lost but has the advantage that the lock can be constructed to a much smaller diameter.

Effectively, the unlocking part 51*a*, 51*b* of the previous example is now constituted solely of the inner part 51*a* with the pin 151 omitted and the recess 51*c* formerly in the outer part 51*b* is now in the edge surface of the sole part 51*b*. With the keeper plates 148 omitted, the outer guide surface 48*b* is provided by the inner surface of an upstanding peripheral wall 48*a* on the barrel member 48 in a manner similar to that of the first described embodiment. No spacer washer 49 is shown in FIG. 10 as it is not essential, but one may be provided as will be understood depending on the axial length of the peripheral wall 48*a* relative to the housing part 30.

The omission of the rib 103 removes the limit stops 103*c* provided in the previously described embodiment. The wall 48*a* is therefore provided with an axially extending rib 48*d* on its inner face against which the parts 51*a* normally abut under the influence of the spring 52 thereby ensuring that the parts 51*a* always return to a defined rest position.

I claim:

1. A revolving cylinder lock comprising a cylindrical barrel mounted coaxially in a cylindrical passage for rotation about the axis thereof characterized by a cylindrical cavity extending partly into the wall of the passage and partly into the barrel with its axis parallel the axis of the barrel and spaced from the axis of the barrel by a distance not less than the radius of the barrel and not greater than the radius of the passage wall, a cylindrical pin coaxially mounted in the cavity for rotation therein and divided into two parts along a cylindrical surface containing the pin axis and having a radius of curvature not less than that of the barrel and not greater than that of the passage, returning means operatively associated with the pin to urge the pin towards an angularly displaced position about its axis in which the axis of the cylindrical dividing surface is displaced from coincidence with the barrel axis and unlocking means operable angularly to displace the pin about its axis to bring the axis of the cylindrical dividing surface into coincidence with the axis of the barrel against the effect of the returning means.

2. A lock according to claim 1 characterized by a plurality of divided cylindrical pins each rotatable in an associated cylindrical cavity.

3. A lock according to claim 2 characterized in that the pins are angularly disposed about the axis of rotation of the barrel.

4. A lock according to claim 2 characterized in that the pins are spaced lengthwise in a direction parallel to the axis of rotation of the barrel.

5. A lock according to any one of claims 1 to 4 characterised in that the unlocking means comprises a separate toothed segment associated with each pin and engaged with teeth formed on the associated pin and angularly displaceable to displace the associated pin against the effect of the returning means.

6. A revolving cylinder lock characterized by a plurality of sub-assemblies each comprising an annular housing part with an annular barrel part mounted coaxially in the housing part for rotation about the axis thereof, a plurality of cylindrical cavities disposed angularly about the axis of each sub-assembly and extending partly into the inner wall of the housing part and partly into the outer wall of the barrel part with their axes parallel to the axis of the barrel part and spaced therefrom by a distance not less than the outer radius of the barrel part and not greater than the inner radius of the housing part, a cylindrical pin coaxially mounted in each cavity for rotation therein and divided into two parts above a cylindrical surface containing the pin axis and having a radius of curvature not less than that of the periphery of the barrel part and not greater than that of the inner wall of the housing part, a separate toothed segment carried on the barrel part for each pin and engaged with teeth formed on the associated pin, spring means associated with the toothed segments operable angularly to displace the toothed segments about the axis of the housing part to a rest or locked position in which the cylindrical dividing surface of each pin is displaced from coincidence with the axis of the housing part, a slot formed in each barrel part to receive a key member operable angularly to displace the toothed segments, to an unlocking position in which the axes of the cylindrical dividing surfaces of the pins are in coincidence with the axis of the barrel member.

7. A revolving cylinder lock comprising a cylindrical barrel mounted coaxially in a cylindrical passage for rotation about the axis thereof, a first cavity part extending into the wall of the passage, a second cavity part extending into the barrel, the first and second cavity parts defining a cylindrical cavity the axis of which is parallel to the axis of the barrel and is spaced therefrom by a distance not less than the radius of the barrel and not greater than the radius of the passage wall, a pin extending in a direction parallel to the axis of the passage and, in the locked condition of the lock extending into both the first and second cavity parts, said pin being one part of a two-part cylindrical pin coaxially mounted in the cavity for rotation therein about its axis, the cylindrical pin being divided into two parts along a cylindrical surface containing the pin axis and having a radius of curvature not less than that of the barrel and not greater than that of the passage, unlocking means retained between inner and outer guide surfaces concentric with said axis and angularly displaceable about said axis to an unlocking position, an edge surface on said unlocking means operatively associated with said outer guide surface and in engagement with said one pin part of the cylindrical pin normally to retain the pin in the locked condition and operable to displace the cylindrical pin about its axis from the locked condition in which said one pin part extends into both the first and second cavity parts with the axis of the cylindrical dividing surface displaced from coincidence with the barrel axis to the unlocked condition in which said one part of the cylindrical pin is outside the first cavity part and the axis of the cylindrical dividing surface substantially coincides with the axis of the barrel to allow the barrel to be rotated relative to the passage and means operable to urge the unlocking means away from the unlocking position.

8. A revolving cylinder lock according to claim 7 in which said edge surface on said unlocking means is formed with a first set of teeth and said one pin part is formed with a second set of teeth, said first and second sets of teeth being engaged to effect engagement between said unlocking means and said one pin part.

9. A revolving cylinder lock according to claim 7 in which a plurality of two-part cylindrical pins are angularly disposed about the axis of rotation of the barrel to form a set and a plurality of sets of two-part cylindrical pins are provided spaced from each other in the direction of said axis of rotation.

10. A revolving cylinder lock comprising a cylindrical barrel mounted coaxially in a cylindrical passage for rotation about the axis thereof, a first cavity part extending into the wall of the passage, a second cavity part extending into the barrel, a locking member which, in the locked condition of the lock extends into both the first and second cavity parts, unlocking means angularly displaceable about said axis from a normal locking position to an unlocking position and arranged normally to retain the locking member in the locked condition and in the unlocking position to release the locking member from engagement in one of the first and second cavity parts to allow the barrel to be rotated relative to the passage and means operable to urge the unlocking means away from the unlocking position towards the normal locking position, the unlocking means comprising a first toothed part defining the normal locking position and a second toothed part defining the unlocking position, the relative angular positions of said first and second toothed parts being selectively adjustable by selective engagement of the teeth of the parts in driving engagement to preselect the angular displacement of said first part from the normal locking position required in order angularly to displace said second part to the unlocking position.

11. A revolving cylinder lock comprising a cylindrical barrel mounted coaxially in a cylindrical passage for rotation about the axis thereof, a first cavity part extending into the wall of the passage, a second cavity part extending into the barrel, a pin extending in a direction parallel to the axis of the passage and, in the locked condition of the lock extending into both the first and second cavity parts, unlocking means comprising a toothed inner part drivingly engaged with a toothed outer part whereby the relative angular positions of the inner and outer parts is adjustable, the unlocking means being retained between inner and outer guide surfaces concentric with said axis and angularly displaceable about said axis to an unlocking position, an edge surface formed on said toothed outer part and concentric about said axis and operatively associated with said outer guide surface and said pin normally to retain the pin in the locked condition, a recess in said edge surface operable to release the pin from engagement in said first cavity part when displaced into coincidence with said second cavity part and spring means operable to urge the unlocking means away from the unlocking position.

12. A revolving cylinder lock according to claim 11 in which said toothed outer part is annular with said recess formed in the outer edge surface thereof and teeth formed on the inner edge thereof and said toothed inner part has a radially extending tooth selectively engageable in the teeth formed on said toothed outer part.

13. A revolving cylinder lock according to claim 11 characterized in that said toothed inner part is retained between said inner guide surface and an inner intermediate guide surface and said toothed outer part is retained between an outer intermediate guide surface and said outer guide surface.

14. A revolving cylinder lock according to claim 12 characterized in that inner and outer guide surfaces are provided by an annular rib formed on the barrel and interrupted to allow the radially extending tooth to extend therethrough and to limit the angular displacement thereof.

15. A revolving cylinder lock according to claim 11, 12, 13 or 14 characterized in that the cylindrical passage is provided by a plurality of axially aligned housing parts, the barrel is provided by a plurality of axially aligned barrel parts each received in a corresponding housing part, two first cavity parts are formed at angularly displaced locations in the wall of each housing part and a separate pin extends partly into each cavity part with its axis parallel to the axis of the passage in the locked condition, and two unlocking means, one associated with each pin, are retained on each of the opposed faces of the barrel part, between the inner and outer guide surfaces concentric about said axis for annular displacement in opposite directions to an unlocking position.

16. A revolving cylinder lock according to claim 15 characterized in that one of the two unlocking means retained on one face of each barrel member and one of the two unlocking means retained on the opposed face are associated with one pin and the other of each of two unlocking means is associated with the other pin, the two of said one unlocking means being angularly displaceable in opposite directions to each other about said axis to the unlocking position and the two of said other unlocking means being angularly displaceable to each other in opposite directions about said axis to the unlocking position.

* * * * *